United States Patent [19]

Compen

[11] Patent Number: 4,801,842

[45] Date of Patent: Jan. 31, 1989

[54] METHOD OF REDUCING DOMING IN A COLOR DISPLAY TUBE AND A COLOR DISPLAY TUBE MADE IN ACCORDANCE WITH THE METHOD

[75] Inventor: Johannes M. A. A. Compen, Eindhoven, Netherlands

[73] Assignee: U.S. Philips Corporation, New York, N.Y.

[21] Appl. No.: 40,423

[22] Filed: Apr. 17, 1987

[30] Foreign Application Priority Data

Apr. 21, 1986 [GB] United Kingdom ..... 8609695

[51] Int. Cl.[4] ..... H01J 29/07

[52] U.S. Cl. ..... 313/402; 313/407

[58] Field of Search ..... 313/402, 407, 408, 477 R, 313/479, 466

[56] References Cited

U.S. PATENT DOCUMENTS 4,659,958 4/1987 D'Amato ..... 313/407

*Primary Examiner*—David K. Moore
*Assistant Examiner*—K. Wieder
*Attorney, Agent, or Firm*—John C. Fox

[57] ABSTRACT

Thermal radiation reflectivity between the upright edge of the faceplate and at least the edge portion of the shadow mask is adjusted to obtain a desired temperature stabilisation level which avoids electron beam spot misalignment, such as by having selected areas of the upright edge non-aluminized while the remainder of the upright edge together with the back of the screen have a layer of aluminium thereon. The size, shape and disposition of the selected areas are chosen to obtain an optimum ratio of aluminized and non-aluminized glass surface which will provide a desired radiation coefficient. Typically at least 35% of the upright edge remains aluminized. In addition, a material having a high radiation coefficient, such as a low melting point glass with a high lead content, may be selectively applied to a peripheral portion of the shadow mask and the adjoining mounting frame.

13 Claims, 2 Drawing Sheets

1/2

METHOD OF REDUCING DOMING IN A COLOR DISPLAY TUBE AND A COLOR DISPLAY TUBE MADE IN ACCORDANCE WITH THE METHOD

BACKGROUND OF THE INVENTION

The present invention relates to a method of reducing doming in a colour display tube and to a colour display tube made in accordance with the method.

Colour display tubes consist of an envelope comprising a faceplate, a cone and a neck. An electron gun system is arranged in the neck. A cathodoluminescent multicolour screen is provided on the interior of the faceplate and an apertured shadow mask is mounted at a short distance from the screen. In operation three electron beams produced by the electron gun system are scanned across the shadow mask by deflection coils mounted at the outside of the neck-cone transition of the envelope. A high percentage of the electrons, up to 80%, impinge upon the shadow mask causing it to heat-up. In the initial phase after switch-n the apertured portion of the shadow mask expands and is deflected or domes towards the screen. This causes mislanding of the electron beams leading to colour distortion. Subsequently heat is lost from the apertured portion of the shadow mask by radiation to the faceplate and by conduction to the frame of the shadow mask which expands and in so doing tightens the shadow mask sheet causing it to be deformed oppositely. This tightening of the shadow mask sheet together with a suitable temperature compensating shadow mask suspension system such as that disclosed in British Patent Specification No. 1192725 or British Patent Specification No. 2097996A ideally causes the shadow mask to be restored to its undeflected state.

U.S. Pat. No. 3,392,297 (Schwartz) discloses applying a layer of a heat absorptive material to the aluminium layer normally covering the phosphors of the cathodoluminescent screen. The patentee remarks that by the screen/faceplate absorbing radiated heat from the part-spherical shaped shadow mask a temperature equalisation state is achieved and consequently doming is compensated for.

U.S. Pat. No. 3,878,428 (Kuzminski et al) discloses applying one of a variety of heat absorbing layers to the centre portion of the screen and a heat reflective material to a peripheral portion of the forward facing surface of the shadow mask; the purpose of this mixture of layers again being to equalise more easily the temperature difference between the part spherical shadow mask and the screen.

In spite of these known methods to counter doming and the consequent misregistration of colours, there still exists a doming problem which is more pronounced in flatter, squarer display tubes currently entering production.

An object of the present invention is to improve the anti-doming characteristics of a colour display tube.

SUMMARY OF THE INVENTION

According to one aspect of the present invention there is provided a method of reducing the effects of doming in a colour display tube comprising a glass faceplate having an upright edge, a cathodoluminescent screen on the inside surface of the faceplate and a shadow mask comprising an apertured sheet having an edge portion which is connected to a mounting frame, characterised in that the thermal radiation reflectivity between the upright edge and at least the edge portion of the apertured sheet is adjusted to obtain the desired temperature stabilisaton level.

This adjustment may be achieved by applying the aluminium film which normally covers the luminescent screen layer on the faceplate so that it extends over the upright edge leaving selected areas of the glass of the upright edge non-aluminised. Typically 35% of the upright edge is covered with aluminium. The size, shape disposition of the selected areas are chosen to obtain the optimum ratio of aluminised and non-aluminised glass surface which will provide a desired radiation coefficient.

Additionally selected areas of the edge portion of the apertured sheet and the mounting frame facing the upright edge of the faceplate may be made extra radiation absorptive by applying a material, such as a low melting point glass with a high lead content, having a high value radiation coefficient thereto.

In order to reduce local doming as may more likely occur in flat square display tubes and higher resolution display tubes, the gun-facing side of the shadow mask may be treated so that it has a high electron reflection coefficient and a high thermal radiation coefficient.

According to another aspect of the present invention there is provided a colour display tube comprising: an envelope including a faceplate having an upright edge, a cone connected to the upright edge and a neck; a cathodoluminescent screen applied to the inside surface of the faceplate; and a shadow mask including an apertured sheet having an edge portion to which a mounting frame is connected; characterised in that the surface of at least the upright edge of the faceplate has been treated to adjust the thermal radiation reflectivity between the upright edge and at least the edge portion of the apertured sheet in order to obtain a predetermined temperature stabilisation level in operation of the display tube.

BRIEF DESCRIPTION OF THE DRAWING

The present invention will now be described, by way of example, with reference to the accompanying drawings, in which.

DESCRIPTION OF THE PREFERRED EMBODIMENT

Figure 1:
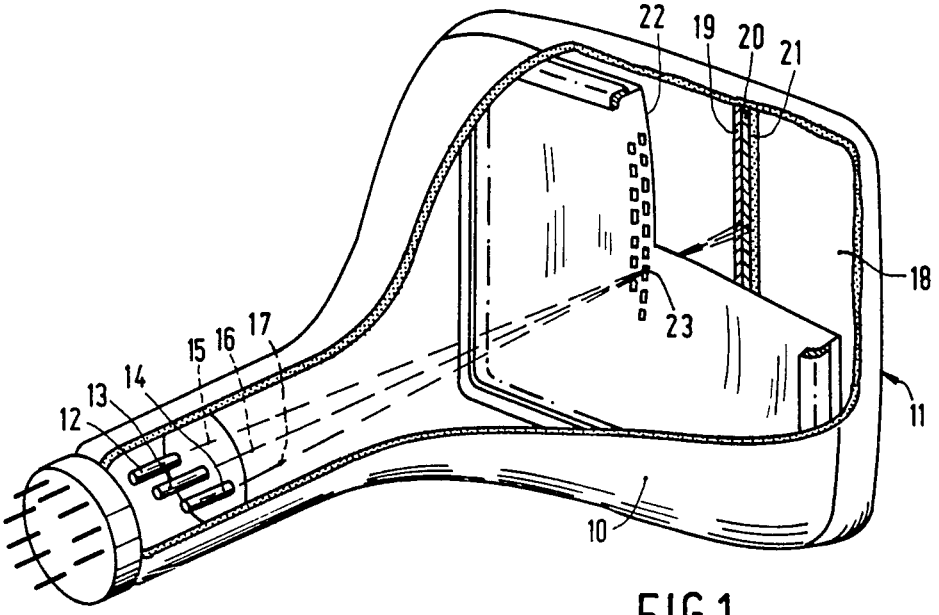
FIG. 1 is a perspective view of a colour display tube with a portion of the envelope broken away.

In the drawings corresponding reference numerals have been used to refer to the same features.

The colour display tube shown diagrammatically in FIG. 1 comprises a glass envelope 10 in which three (diagrammatically shown) electron guns 12, 13 and 14 are present to generate three electron beams 15, 16 and 17. A display screen 18 is built up on a faceplate 11 from a recurring pattern of phosphor stripes 19, 20 and 21 luminescing in blue, green and red, the stripes associated with the electron beams 15, 16 and 17 in such a manner that each electron beam impinges only on phosphor stripes of one colour. This is realized in the known manner by means of a shadow mask 22 which is suspended at a short distance before the display screen 18 and has rows of apertures 23 which pass a portion of the electron beams 15, 16 and 17. Only approximately 20% of the electrons pass through the aperture 23 on their way to the display screen 18. The remainder of the electrons are intercepted by the shadow mask 22, in which their kinetic energy is converted to thermal energy. In normal operating conditions of a colour display tube, the temperature of a mild steel shadow mask 22 may increase to approximately 75° to 80° C. depending on the beam current. Although in the interest of clarity the means for suspending the shadow mask have not been illustrated, a temperature compensating shadow mask suspension system is used. Two alternative types of suitable mask suspension systems are disclosed in British Patent Specification No. 1192725, details of which are incorporated by way of reference.

Figure 2:
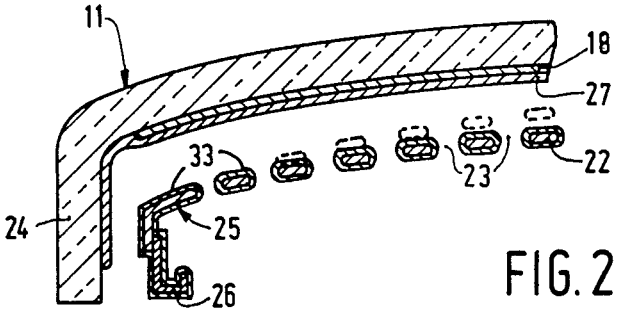
FIG. 2 is a diagrammatic cross-sectional view through a portion of one embodiment of a faceplate and a shadow mask of the invention.

Referring to FIG. 2, the faceplate 11 comprises an upright edge 24 and the shadow mask 22 comprises a central portion having the apertures 23 and a peripheral portion 25 with an upright edge which is connected, for example by laser welding, to a lightweight mild steel frame 26. The shadow mask 22 and its frame 26 are thermally blackened as indicated by a layer 33. Generally a film 27 of evaporated aluminium covers the screen 18 and the upright edge. This aluminium layer has a low infra-red radiation coefficient which in turn affects in an adverse way the overall and local doming behaviour of the shadow mask.

The problem of doming of the shadow mask 22 is generally known and concerns the warming-up phase of a colour display tube. More particularly, at switch-on the faceplate is at ambient temperature and the perforated area of the shadow mask 22 becomes heated in response to electron beam impingement. This heating causes the perforated area of the shadow mask 22 to move towards the screen 18, as shown in broken lines. This effect can lead to some colour distortion resulting from mislanding of the electron beams passing through the apertures 23 in the shadow mask. As the display tube continues to warm-up the peripheral portion 25 of the shadow mask and the frame 26 become heated by way of thermal conduction and radiation, and in consequence then expand causing tensioning of the perforated central portion and ideally restoring it to its original shape. However, the mask is nevertheless at a higher temperature level so that each mask aperture is shifted outwards. This shift is adjusted by an appropriate temperature compensating shadow mask suspension system which moves the mask towards the screen, so that, ideally the original position of the mask aperture, looked at from the deflection point is restored.

Figure 3:
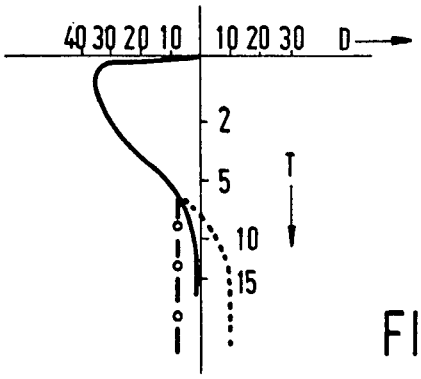
FIG. 3 is a graph of displacement (D) of a spot on a phosphor line in micrometers (μm) versus time (T) in minutes, the ordinate having a logarithmic scale, of a mild steel shadow mask.

FIG. 3 illustrates three hypothetical situations where, very shortly after switch-on, there is a pronounced displacement of the spot on the phosphor line due to doming but after a time, say 15 minutes, thermal stabilisation has been achieved displacement of the spot has been reduced ideally to zero. If, however, by applying certain doming reducing measures there is more radiation loss from the apertured portion, then the resultant thermally stabilised position of the mask in the opposite direction and the displacement of the spot is as shown by a dotted line. Conversely, if there is less radiation loss from the apertured portion, then the shadow mask will remain slightly dome in the original direction and the displacement of the spot is as indicated by the dash-dot line.

In accordance with the method of the present invention, the radiation between the upright edge 24 of the faceplate and shadow mask is adjusted by adjusting the radiation coefficient of either the upright edge 24 or the shadow mask, in order to obtain a constant temperature profile so that a substantially constant stabilisation level is achieved, leading to elimination of doming.

An accurate and consistent way from the point of view of manufacture to obtain an acceptable overall coefficient of radiation especially in the case of a colour display tube with a mild steel shadow mask, is to have predetermined areas of glass at the upright edge 24 non-aluminized whilst concurrently ensuring that there is sufficient aluminium film 27 to avoid flashing on the screen the few seconds after switching-on the set. This phenomenon is caused by cold emission sources, such as residues from the screen-making process, on the non-aluminized glass surface.

The radiation coefficient $\alpha$ of glass is of the order of 0.95 and that of aluminium, that is, the film 27, is of the order of 0.10. The overall radiation coefficient of the upright edge can be adjusted empirically between these values. For example, $\alpha=0.65$ is obtained by covering 35% of the surface of the upright edge with aluminium.

Figure 4:
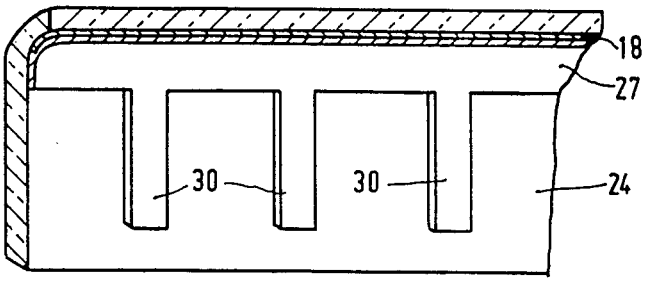
FIGS. 4 and 5 are perspective views through a portion of an upright edge of a faceplate in which portions of the glass are selectively covered by an aluminium layer.

One embodiment of the invention is illustrated in FIG. 4 where the aluminium film 27 comprises finger-like extensions 30 of the main film 27 covering the screen 18. The extensions 30 which are for example 30 mm long, stop short of the end of upright edge 24 by approximately 10 mm.

Figure 5:
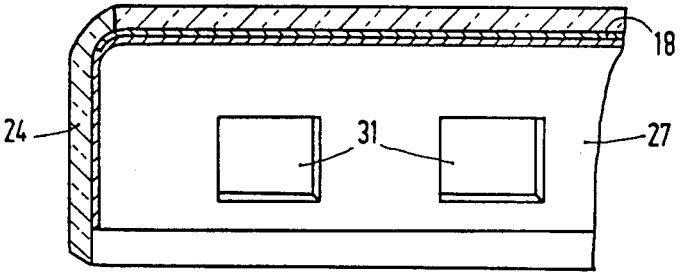

In the embodiment of FIG. 5, the selected areas of exposed glass comprise suitably shaped windows 31 in the aluminium film 27.

In implementing the embodiments of FIGS. 4 and 5, the required area of glass to be exposed has to be determined empirically for the particular model of the display tube, and then the aluminium film is patterned, either by selective masking of the glass while aluminium is evaporated onto the screen 18 and exposed areas of the upright edge 24 or by selective etching to remove predetermined areas of an aluminium film 27 after evaporation.

In an extreme case no aluminium is present on the upright edge. Consequently the flashing phenomenon can either be accepted or special measures taken, such as careful cleaning, to remove sources giving rise to this phenomenon.

Figure 6:
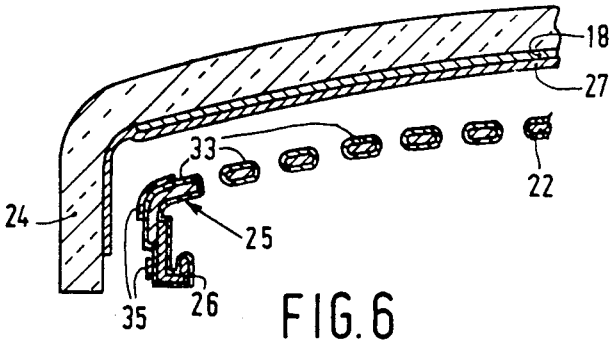
FIG. 6 is a diagrammatic cross-sectional view through a portion of another embodiment of a faceplate and a shadow mask of the invention.

FIG. 6 shows an embodiment in which the measures already described are inadequate in the sense that insufficient heat is absorbed by the exposed glass of the upright edge 24 which means that $\alpha$ is too low. Consequently additional measures have to be taken. Selective areas of the thermally blackened layer 33, which has an $\alpha$ of the order of 0.7, on the peripheral portion 25 and the frame 26 have a coating 35 of an extra heat absorptive material applied thereto. Such a material will have an $\alpha$ of the order of 0.95 and may typically comprise a low melting point glass with a high lead content. The thickness of the coating 35 is in the range 1 to 10 $\mu$m. The selective areas comprises patterns which enable the overall $\alpha$ of the peripheral portion 25 and the frame 26 to be between 0.7 and 0.95 thereby influencing the stabilisation level of the curve shown in FIG. 3.

In the case of flat square tubes or tubes with a higher resolution whose performance is more susceptible to the effects of doming, additional measures beyond those already described may have to be taken to reduce or eliminate the effects of local doming. Generally speaking the side of the shadow mask facing the electron gun should have a high electron reflection coefficient and a high thermal radiation coefficient. Amongst the options available to achieve such characteristics on a mild steel or mild steel alloy shadow mask is to apply a porous layer of a heavy metal or compounds, alloys or mixtures of heavy metals having an atomic number exceeding 70 to the surface of the shadow mask. Such a method is disclosed in British Patent No. 2080612, details of which are incorporated herein by way of reference. Another option is to apply lead glass to said surface but the benefits are reduced if the lead glass is covered by barium from the getter since it decreases the infra-red emissivity of the mask. Thermally blackening said surface is another possibility.

What is claimed is:

1. A method of reducing the effects of doming in a colour display tube comprising a glass faceplate having an upright edge, a cathodoluminescent screen on the inside surface thereof, an aluminum film applied over the luminescent screen and over the upright edge, and a shadow mask comprising an apertured sheet having an edge portion connected to a mounting frame, characterised in that the thermal radiation reflectivity between the upright edge and at least the edge portion of the apertured sheet is adjusted to obtain a desired temperature stabilisation level, by at least leaving selected areas of the glass of the upright edge non-aluminized, substantially 35 percent of the upright edge remaining aluminized, the size, shape and disposition of said selected areas being chosen so that a desired radiation coefficient is obtained.

2. A method as claimed in claim 1, characterised in that the reflectivity is additionally adjusted by appling a radiation reflective coating of a material having a high value of radiation coefficient to selected areas of the edge portion of the apertured sheet and the mounting frame facing the upright edge of the faceplate, whereby these areas are made extra radiation absorptive.

3. A method as claimed in claim 4, characterised in that the material comprises a low melting point glass with a high lead content.

4. A method as claimed in claim 1, characterised in that the side of the apertured sheet facing away from the faceplate is coated with a porous layer of a heavy metal or a compound of a heavy metal, the metal having an atomic number exceeding 70, and the layer having a high electron reflection coefficient.

5. A method as claimed in claim 4, characterized in that the heavy metal compound is bismuth oxide.

6. A method as claimed in claim 1, characterised in that the central apertured portion of the side of the apertured sheet facing away from the faceplate is thermally blackened.

7. A method as claimed in claim 2, characterised in that a radiation reflective coating is applied to the peripheral area of the apertured sheet and the mounting frame on the side facing away from the faceplate.

8. A colour display tube comprising: an envelope including a faceplate having an upright edge, a cone connected to the upright edge and a neck; a cathodoluminescent screen on the inside surface of the faceplate; an aluminium film on the screen and the upright edge; and a shadow mask comprising an apertured sheet having an edge portion connected to a mounting frame, characterised in that selected areas of the upright edge of the faceplate are non-aluminized, substantially 35 percent of the upright edge being aluminized, thereby to adjust the thermal radiation reflectivity between the upright edge and at least the edge portion of the apertured sheet in order to obtain a predetermined temperature stabilisation level in operation of the display tube.

9. A colour display tube as claimed in claim 8, characterised in that selected areas of the edge portion of the apertured sheet and the mounting frame facing the upright edge of the faceplate have a radiation reflective coating of a material having a high value of radiation coefficient.

10. A colour display tube as claimed in claim 9, characterised in that the material comprises a low melting point glass with a high lead content.

11. A colour display tube as claimed in claim 8, characterised in that the surface of the apertured sheet remote from the faceplate has thereon a porous layer of a heavy metal or a compound of a heavy metal, the metal having an atomic number exceeding 70 and the layer having a high electron reflection coefficient.

12. A color display tube as claimed in claim 11, characterised in that the compound comprises bismuth oxide.

13. A color display tube as claimed in claim 8, characterised in that the surface of the apertured portion of the apertured sheet remote from the faceplate is thermally blackened.

* * * * *